US010619858B2

(12) United States Patent
Paller

(10) Patent No.: US 10,619,858 B2
(45) Date of Patent: Apr. 14, 2020

(54) FUEL SUPPLY SYSTEM FOR A GAS BURNER ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 92 days.

(21) Appl. No.: 15/891,467

(22) Filed: Feb. 8, 2018

(65) Prior Publication Data

US 2019/0242583 A1 Aug. 8, 2019

(51) Int. Cl.

| | |
|---|---|
| ***F24C 5/18*** | (2006.01) |
| ***F24C 1/04*** | (2006.01) |
| ***F24C 3/10*** | (2006.01) |
| ***F23N 5/02*** | (2006.01) |
| ***F23N 5/26*** | (2006.01) |
| ***F23N 1/00*** | (2006.01) |
| ***F23D 14/06*** | (2006.01) |

(52) U.S. Cl.

CPC ..... *F24C 1/04* (2013.01); *F23D 14/06* (2013.01); *F23N 1/002* (2013.01); *F23N 5/025* (2013.01); *F23N 5/265* (2013.01); *F24C 3/103* (2013.01); *F23D 2900/14062* (2013.01); *F23N 2035/16* (2013.01); *F23N 2037/02* (2013.01); *F23N 2041/08* (2013.01)

(58) Field of Classification Search

CPC ..... F24C 3/12; F24C 5/18; F23N 1/00; F23N 5/20; F23K 2900/00

See application file for complete search history.

(56) References Cited

U.S. PATENT DOCUMENTS

| | | | | |
|---|---|---|---|---|
| 5,321,229 A * | 6/1994 | Holling | F24C 7/087 | 219/445.1 |
| 5,662,465 A * | 9/1997 | Kano | F23N 5/022 | 126/19 R |
| 7,255,100 B2 * | 8/2007 | Repper | F23N 1/005 | 126/39 BA |
| 7,527,072 B2 * | 5/2009 | Crnkovich | F24C 3/126 | 126/39 G |

(Continued)

FOREIGN PATENT DOCUMENTS

| | | | |
|---|---|---|---|
| DE | 102010006276 A1 | 7/2011 | |
| WO | WO2000063620 A1 | 10/2000 | |

*Primary Examiner* — Gregory A Wilson

(74) *Attorney, Agent, or Firm* — Dority & Manning, P. A.

(57) ABSTRACT

A fuel supply system for a gas burner assembly is provided. The gas burner assembly includes an inner burner stage positioned concentrically within an outer burner stage. The fuel supply system includes a fuel supply for providing a primary flow of fuel through a primary fuel conduit. A control valve and a modulating valve are operably coupled in series on the primary fuel conduit for regulating the primary flow of fuel. A first fuel supply conduit and a second fuel supply conduit tee off the primary fuel conduit to supply fuel to the outer burner stage and the inner burner stage, respectively. A shutoff valve is operably coupled to the first fuel supply conduit for stopping the flow of fuel through the first fuel supply conduit, e.g., during a simmer operation.

19 Claims, 7 Drawing Sheets

(56) References Cited

U.S. PATENT DOCUMENTS

| | | | | |
|---|---|---|---|---|
| 7,881,593 | B2 * | 2/2011 | Grassi | F24C 15/10 392/480 |
| 8,001,957 | B2 | 8/2011 | Clauss et al. | |
| 10,228,144 | B2 * | 3/2019 | Johncock | F24C 3/085 |
| 2006/0051718 | A1 * | 3/2006 | Kamal | F23D 14/06 431/354 |
| 2007/0068511 | A1 * | 3/2007 | Bachinsky | F24B 1/1808 126/503 |
| 2015/0184866 | A1 * | 7/2015 | Bassetti | F23N 5/203 431/6 |

* cited by examiner

FUEL SUPPLY SYSTEM FOR A GAS BURNER ASSEMBLY

FIELD OF THE INVENTION

The present subject matter relates generally to gas burner assemblies, and more particularly, to fuel supply systems for supplying a mixture of fuel and air into gas burner assemblies.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Certain gas burners include two stages which may operate simultaneously or independently of each other to provide a larger range of heat output at finer increments. Controlling the flow of fuel to each of the respective stages typically requires complex fuel supply systems and multiple costly control valves. In addition, such conventional fuel supply systems do not allow for the use of modulating valves and the ability to use external controllers or remote devices to regulate the burner output in a simple and intuitive manner.

Accordingly, a cooktop appliance including an improved gas burner assembly with a large operating range and improved versatility would be desirable. More particularly, a gas burner assembly having multiple burner stages and a fuel supply system that permits remote modulation and control without costly or complicated plumbing or valve configurations would be particularly beneficial.

BRIEF DESCRIPTION OF THE INVENTION

The present disclosure relates generally to a fuel supply system for a gas burner assembly. The gas burner assembly includes an inner burner stage positioned concentrically within an outer burner stage. The fuel supply system includes a fuel supply for providing a primary flow of fuel through a primary fuel conduit. A control valve and a modulating valve are operably coupled in series on the primary fuel conduit for regulating the primary flow of fuel. A first fuel supply conduit and a second fuel supply conduit tee off the primary fuel conduit to supply fuel to the outer burner stage and the inner burner stage, respectively. A shutoff valve is operably coupled to the first fuel supply conduit for stopping the flow of fuel through the first fuel supply conduit, e.g., during a simmer operation. Additional aspects and advantages of the invention will be set forth in part in the following description, or may be apparent from the description, or may be learned through practice of the invention.

In one exemplary embodiment, a cooktop appliance is provided including a top panel and a gas burner assembly positioned at the top panel, the gas burner assembly including one or more burner bodies defining a first plurality of flame ports, a first fuel chamber in fluid communication with the first plurality of flame ports, a second plurality of flame ports, and a second fuel chamber in fluid communication with the second plurality of flame ports. A fuel supply system includes a fuel supply for providing a primary flow of fuel through a primary fuel conduit and a control valve operably coupled to the primary fuel conduit for regulating the primary flow of fuel. A modulating valve is operably coupled to the primary fuel conduit in series with the control valve for regulating the primary flow of fuel. A first fuel supply conduit provides fluid communication between the primary fuel conduit and the first fuel chamber and a second fuel supply conduit provides fluid communication between the primary fuel conduit and the second fuel chamber.

In another exemplary embodiment, a fuel supply system for a gas burner assembly is provided. The gas burner assembly includes an inner burner stage positioned concentrically within an outer burner stage. The fuel supply system includes a fuel supply for providing a primary flow of fuel through a primary fuel conduit and a control valve operably coupled to the primary fuel conduit for regulating the primary flow of fuel. A modulating valve is operably coupled to the primary fuel conduit in series with the control valve for regulating the primary flow of fuel. A first fuel supply conduit provides fluid communication between the primary fuel conduit and the outer burner stage and a second fuel supply conduit provides fluid communication between the primary fuel conduit and the inner burner stage. A shutoff valve is operably coupled to the first fuel supply conduit for selectively stopping the flow of fuel through the first fuel supply conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
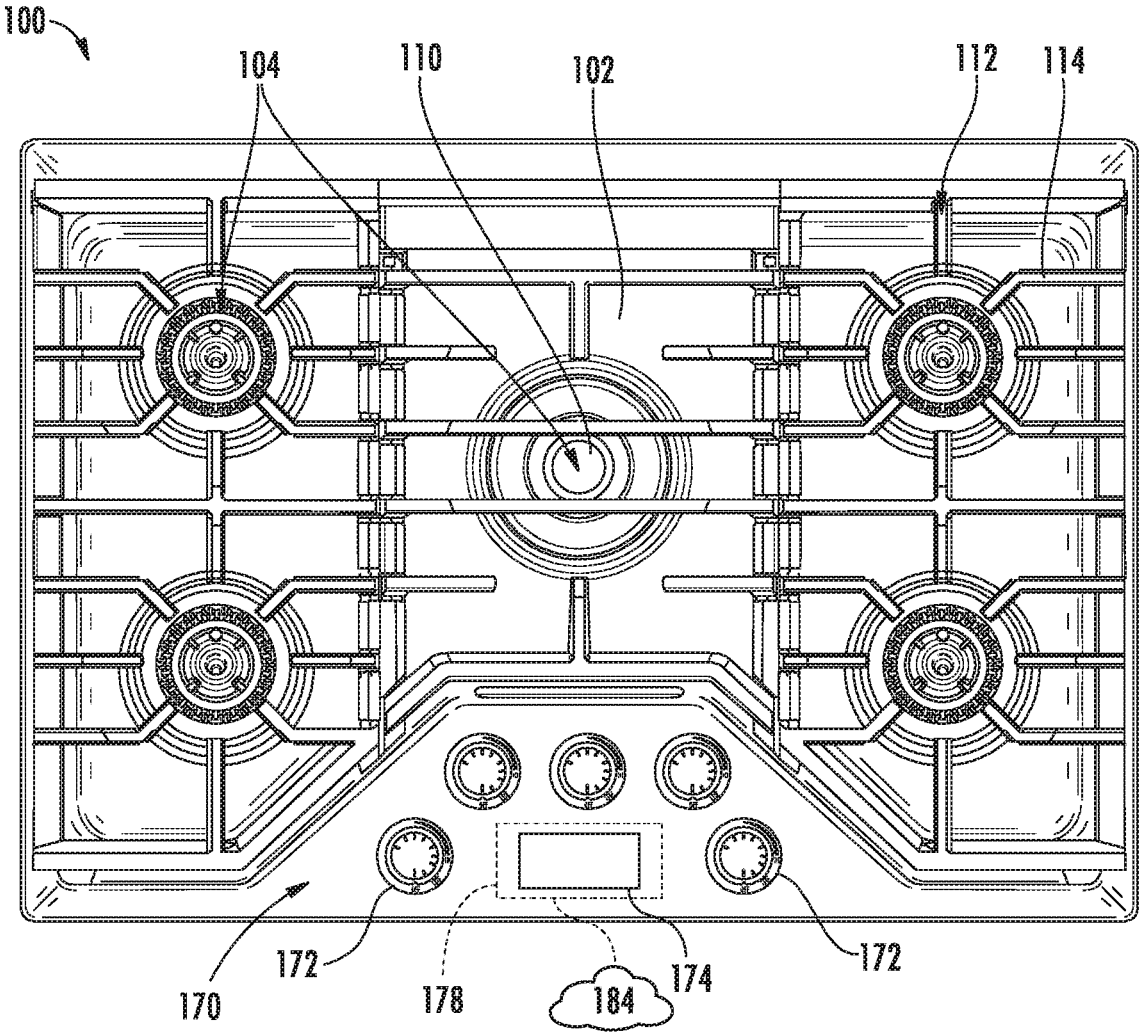
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated embodiment, cooktop appliance 100 is a gas cooktop and heating elements 104 are gas burners, such as a gas burner assembly 110 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 112 configured to support a cooking utensil, such as a pot, pan, etc. In general, grates 112 include a plurality of elongated members 114, e.g., formed of cast metal, such as cast iron. The cooking utensil may be placed on the elongated members 114 of each grate 112 such that the cooking utensil rests on an upper surface of elongated members 114 during the cooking process. Heating elements 104 are positioned underneath the various grates 112 such that heating elements 104 provide thermal energy to cooking utensils above top panel 102 by combustion of fuel below the cooking utensils.

Figure 2:
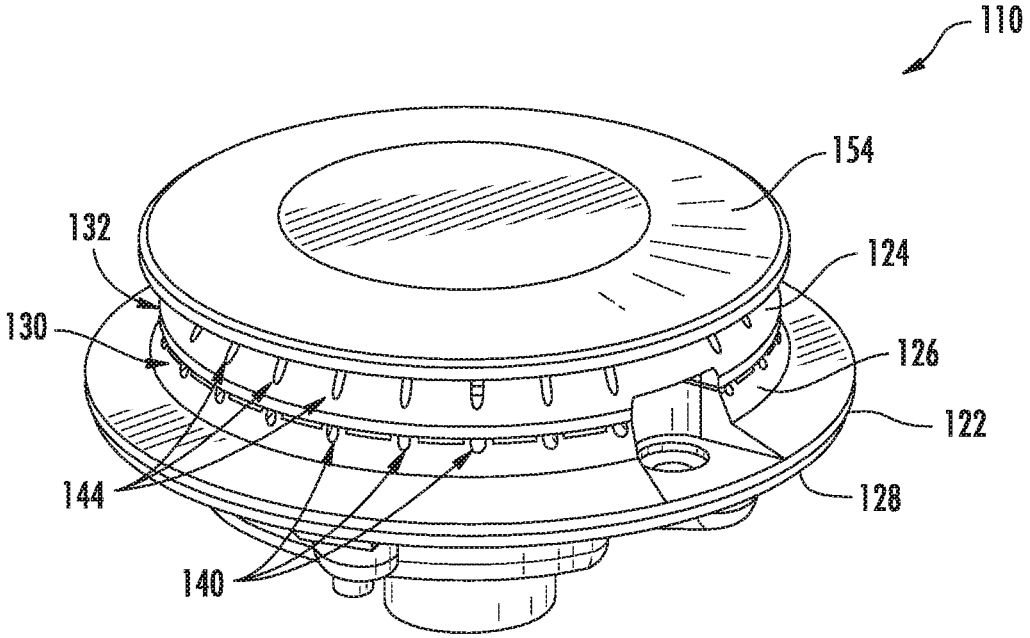
FIG. 2 provides a perspective view of a gas burner assembly of the exemplary cooktop appliance of FIG. 1 according to an exemplary embodiment of the present subject matter.
Figure 3:
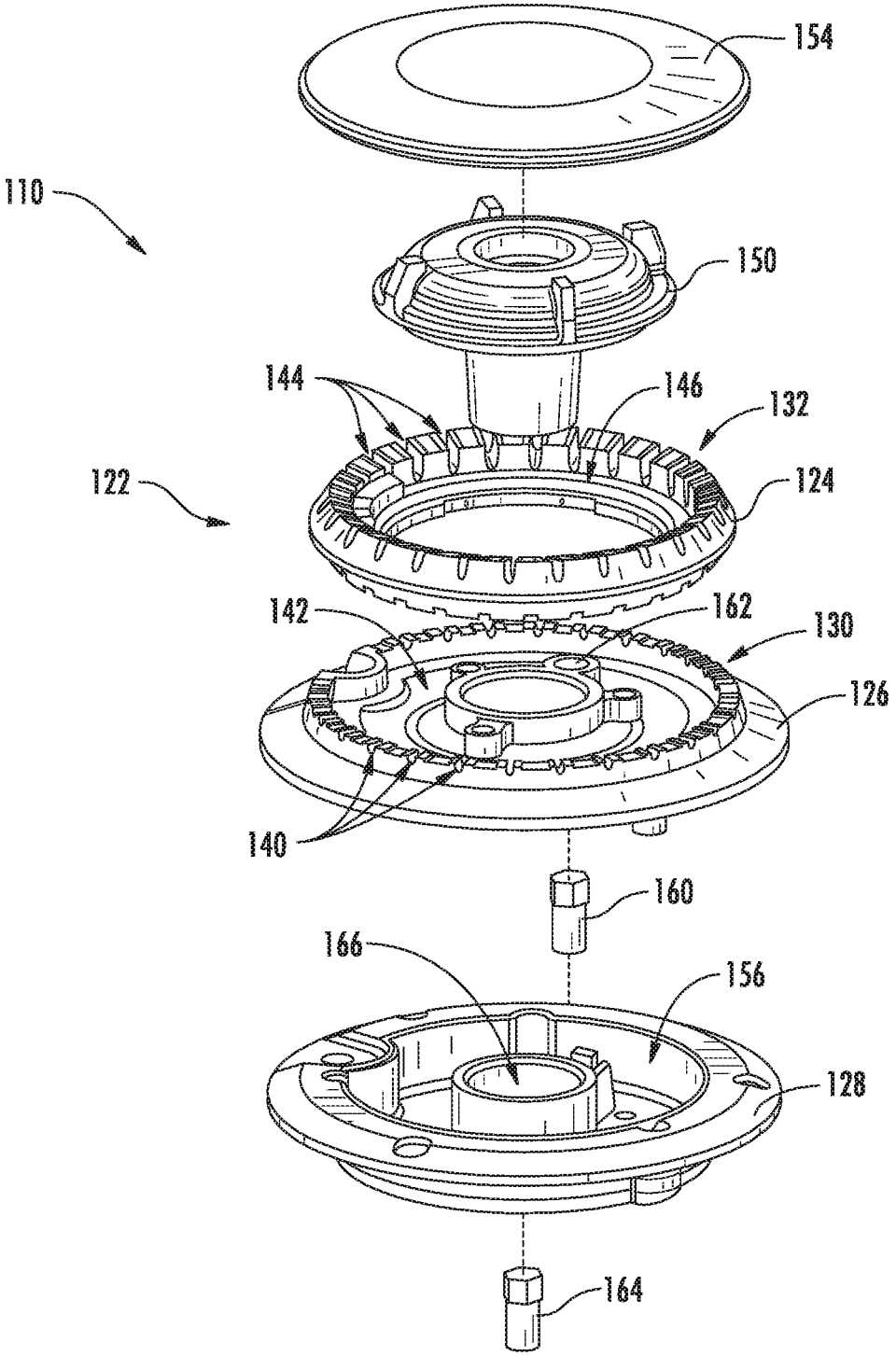
FIG. 3 provides an exploded perspective view of the exemplary gas burner assembly of FIG. 2.
Figure 4:
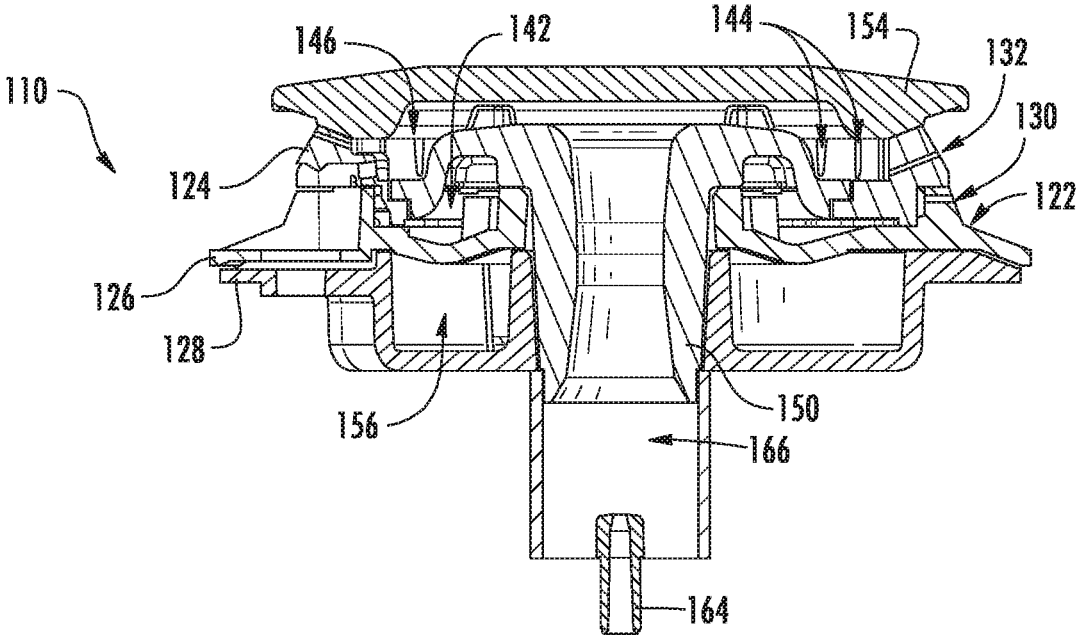
FIG. 4 provides a cross sectional view of the exemplary gas burner assembly of FIG. 2.
Figure 5:
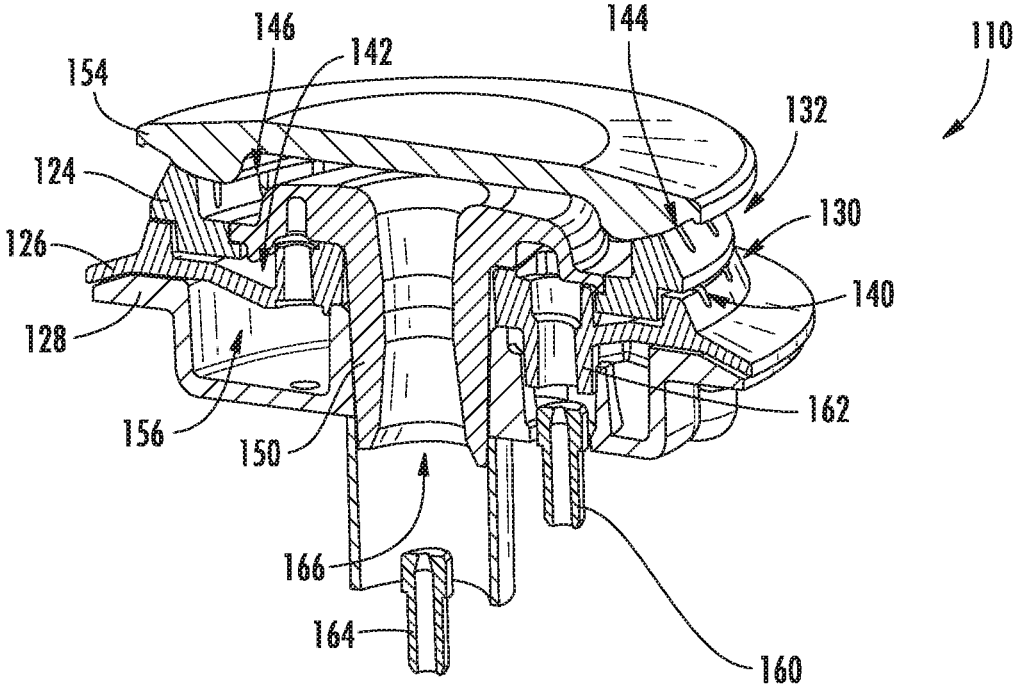
FIG. 5 provides another cross sectional view of the exemplary gas burner assembly of FIG. 2.

FIG. 2 is a perspective view of gas burner assembly 110. FIG. 3 is an exploded view of gas burner assembly 110. FIGS. 4 and 5 are cross sectional views of gas burner assembly 110. As an example, gas burner assembly 110 may be used in cooktop appliance 100 (FIG. 1) as one of heating elements 104. However, it will be understood that, while described in greater detail below in the context of cooktop appliance 100, gas burner assembly 110 may be used in or with any suitable appliance in alternative example embodiments.

As may be seen in FIGS. 2 through 5, gas burner assembly 110 includes one or more burner bodies 122, which may include for example, a first burner body 124, a second burner body 126, and a third burner body 128. Burner bodies 122 generally define a first burner ring or stage 130 (e.g., an outer burner) and a second burner ring or stage 132 (e.g., an inner burner). More specifically, first burner stage 130 generally includes a first plurality of flame ports 140 and a first fuel chamber 142 which are defined by first burner body 124 and second burner body 126. Similarly, second burner stage 132 generally includes a second plurality of flame ports 144 and a second fuel chamber 146 which are defined at least in part by first burner body 124.

Gas burner assembly 110 may also include an air duct 150 and a cap 154. First plurality of flame ports 140 may be defined on second burner body 126, e.g., at a circular outer wall of second burner body 126. Similarly, second plurality of flame ports 144 may be defined on first burner body 124, e.g., at a circular outer wall of first burner body 124. Second fuel chamber 146 may be defined by inner surfaces of cap 154, air duct 150, and first burner body 124. First fuel chamber 142 may be defined by inner surfaces of air duct 150, first burner body 124, and second burner body 126. First fuel chamber 142 is separate or independent from second fuel chamber 146 within gas burner assembly 110. Thus, first fuel chamber 142 is not in flow communication with second fuel chamber 146 within gas burner assembly 110. In addition, an air chamber 156 may be defined by second burner body 126 and third burner body 128.

As may be seen in FIGS. 2 through 4, first plurality of flame ports 140 may be positioned concentric with second plurality of flame ports 144. Further, first plurality of flame ports 140 (and first burner stage 130) may be positioned below second plurality of flame ports 144 (and second burner stage 132). Such positioning of first burner stage 130 relative to second burner stage 132 may improve combustion of gaseous fuel when both stages 130, 132 are ignited. For example, flames at first burner stage 130 may assist with lighting gaseous fuel at second burner stage 132 due to the position of first burner stage 130 below second burner stage 132.

According to the exemplary illustrated embodiment, first burner stage 130 and second burner stage 132 are normally aspirated burners that rely on the energy available in the form of pressure from the fuel supplied to the gas burner to entrain air for combustion. In this regard, for example, as best shown in FIGS. 3 and 5, a first orifice 160 is positioned at, e.g., directly below and/or concentric with, a Venturi inlet passage 162 on second burner body 126. Venturi inlet passage 162 is in fluid communication with first fuel chamber 142. Thus, gaseous fuel from first orifice 160 may flow into first fuel chamber 142 through Venturi inlet passage 162. From first fuel chamber 142, the mixture of gaseous fuel and air may flow through and be combusted at first plurality of flame ports 140. Thus, first plurality of flame ports 140 are in fluid communication with first fuel chamber 142 such that the mixture of gaseous fuel and air within first fuel chamber 142 is flowable through first plurality of flame ports 140. Venturi inlet passage 162 assists with naturally aspirating first burner stage 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

Similarly, for example, as best shown in FIGS. 3 through 5, a second orifice 164 is positioned at, e.g., directly below and/or concentric with, a second stage inlet passage 166 defined by third burner body 128. Second stage inlet passage 166 is in fluid communication with second fuel chamber 146 such that gaseous fuel from second orifice 164 may flow into second fuel chamber 146 through second stage inlet passage 166. From second fuel chamber 146, the mixture of gaseous fuel and air may flow through and be combusted at second plurality of flame ports 144. Thus, second plurality of flame ports 144 are in fluid communication with second fuel chamber 146 such that the mixture of gaseous fuel and air within second fuel chamber 146 is flowable through second plurality of flame ports 144. Second stage inlet passage 166 may define any suitable shape or profile, e.g., similar to Venturi inlet passage 162, to assist with naturally aspirating second burner stage 132.

Referring again to FIG. 1, cooktop appliance 100 includes a user interface panel or control panel 170 located within convenient reach of a user of cooktop appliance 100. For this exemplary embodiment, control panel 170 includes control knobs 172 that are each associated with one of heating elements 104. Control knobs 172 allow the user to activate each heating element 104 and regulate the amount of heat input each heating element 104 provides to a cooking utensil located thereon, as described in more detail below.

Although cooktop appliance 100 is illustrated as including control knobs 172 for controlling gas burner assemblies 110, it should be understood that control knobs 172 and the configuration of cooktop appliance 100 shown in FIG. 1 is provided by way of example only. More specifically, control panel 170 may include various input components, such as one or more of a variety of touch-type controls, electrical, mechanical or electro-mechanical input devices including rotary dials, push buttons, and touch pads. Control panel 170 may also be provided with one or more graphical display devices, such as a digital or analog display device designed to provide operational feedback to a user. For example, as illustrated in FIG. 1, cooktop appliance 100 may include a digital display and touch screen interface 174 for displaying information and receiving inputs.

According to the illustrated embodiment, control knobs 172 are located within control panel 170 of cooktop appliance 100. However, it should be appreciated that this location is used only for the purpose of explanation, and that other locations and configurations of control panel 170 and control knobs 172 are possible and within the scope of the present subject matter. Indeed, according to alternative embodiments, control knobs 172 may instead be located directly on top panel 102 or elsewhere on cooktop appliance 100, e.g., on a backsplash, front bezel, or any other suitable surface of cooktop appliance 100.

Operation of cooktop appliance 100 is controlled by electromechanical switches or by a controller or processing device 178 (FIGS. 1 and 6) that is operatively coupled to control panel 170 for user manipulation, e.g., to control the operation of heating elements 104. In response to user manipulation of control panel 170 (e.g., via control knobs 172 and/or touch screen interface 174), controller 178 operates the various components of cooktop appliance 100 to execute selected instructions, commands, or other features.

As described in more detail below with respect to FIG. 6, controller 178 may include a memory and microprocessor, such as a general or special purpose microprocessor operable to execute programming instructions or micro-control code associated with appliance operation. Alternatively, controller 178 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 170 and other components of cooktop appliance 100 may be in communication with controller 178 via one or more signal lines or shared communication busses.

Figure 6:
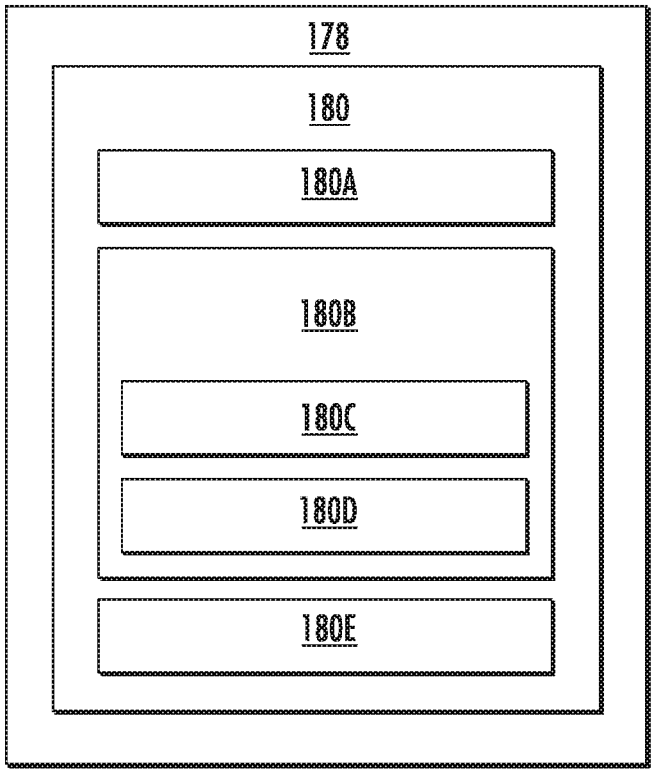
FIG. 6 depicts certain components of a controller according to example embodiments of the present subject matter.

FIG. 6 depicts certain components of controller 178 according to example embodiments of the present disclosure. Controller 178 can include one or more computing device(s) 180 which may be used to implement methods as described herein. Computing device(s) 180 can include one or more processor(s) 180A and one or more memory device(s) 180B. The one or more processor(s) 180A can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 180B can include one or more non-transitory computer-readable storage medium(s), such as RAM, ROM, EEPROM, EPROM, flash memory devices, magnetic disks, etc., and/or combinations thereof.

The memory device(s) 180B can include one or more computer-readable media and can store information accessible by the one or more processor(s) 180A, including instructions 180C that can be executed by the one or more processor(s) 180A. For instance, the memory device(s) 180B can store instructions 180C for running one or more software applications, displaying a user interface, receiving user input, processing user input, etc. In some implementations, the instructions 180C can be executed by the one or more processor(s) 180A to cause the one or more processor(s) 180A to perform operations, e.g., such as one or more portions of methods described herein. The instructions 180C can be software written in any suitable programming language or can be implemented in hardware. Additionally, and/or alternatively, the instructions 180C can be executed in logically and/or virtually separate threads on processor(s) 180A.

The one or more memory device(s) 180B can also store data 180D that can be retrieved, manipulated, created, or stored by the one or more processor(s) 180A. The data 180D can include, for instance, data to facilitate performance of methods described herein. The data 180D can be stored in one or more database(s). The one or more database(s) can be connected to controller 178 by a high bandwidth LAN or WAN, or can also be connected to controller through network(s) 184. The one or more database(s) can be split up so that they are located in multiple locales. In some implementations, the data 180D can be received from another device.

The computing device(s) 180 can also include a communication module or interface 180E used to communicate with one or more other component(s) of controller 178 or cooktop appliance 100 over the network(s) 184. The communication interface 180E can include any suitable components for interfacing with one or more network(s), including for example, transmitters, receivers, ports, controllers, antennas, or other suitable components.

The network(s) 184 can be any type of communications network, such as a local area network (e.g. intranet), wide area network (e.g. Internet), cellular network, or some combination thereof and can include any number of wired and/or wireless links. The network(s) 184 can also include a direct connection between one or more component(s) of the appliance. In general, communication over the network(s) 184 can be carried via any type of wired and/or wireless connection, using a wide variety of communication protocols (e.g., TCP/IP, HTTP, SMTP, FTP), encodings or formats (e.g., HTML, XML), and/or protection schemes (e.g., VPN, secure HTTP, SSL).

The technology discussed herein makes reference to servers, databases, software applications, and other computer-based systems, as well as actions taken and information sent to and from such systems. It should be appreciated that the inherent flexibility of computer-based systems allows for a great variety of possible configurations, combinations, and divisions of tasks and functionality between and among components. For instance, computer processes discussed herein can be implemented using a single computing device or multiple computing devices (e.g., servers) working in combination. Databases and applications can be implemented on a single system or distributed across multiple systems. Distributed components can operate sequentially or in parallel. Furthermore, computing tasks discussed herein as being performed at the computing system (e.g., a server system) can instead be performed at a user computing device. Likewise, computing tasks discussed herein as being performed at the user computing device can instead be performed at the computing system.

Figure 7:
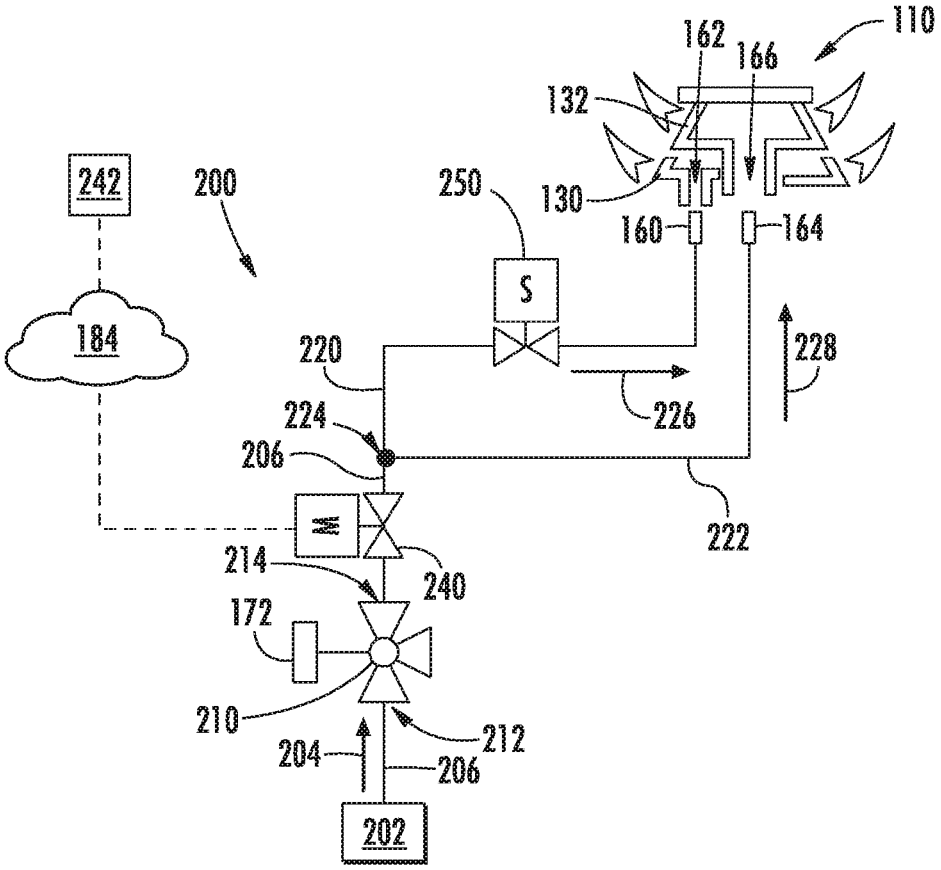
FIG. 7 provides a schematic view of a fuel supply system for providing a flow of fuel to a gas burner assembly according to an example embodiment of the present subject matter.

Referring now to FIG. 7, a schematic view of gas burner assembly 110 and a fuel supply system 200 will be described according to an exemplary embodiment. For the purpose of explanation, simplified renderings of first burner stage 130 and second burner stage 132 of gas burner assembly 110 are illustrated in schematic form in FIG. 7. Similar reference numerals may be used to refer to the same or analogous features throughout the figures. In addition, although fuel supply system 200 is illustrated as being used with gas burner assembly 110, it should be appreciated that fuel supply system 200 as described herein may be used in any suitable gas burner assembly and in any suitable cooktop appliance.

In general, fuel supply system 200 is configured for selectively supplying gaseous fuel such as propane or natural gas to first burner stage 130 and second burner stage 132 to regulate the amount of heat generated by the respective stages. In particular, fuel supply system 200 regulates the output of both first and second burner stages 130, 132 depending upon the desired output of gas burner assembly 110 selected by a user of gas burner assembly 110, e.g., using control knob 172 or other control input. Thus, first burner stage 130 is separate or independent from second burner stage 132, e.g., such that first burner stage 130 is not in fluid communication with second burner stage 132 within gas burner assembly 110. In such manner, gaseous fuel within gas burner assembly 110 does not flow between first and second burner stages 130, 132.

As shown in FIG. 7, fuel supply system 200 may include a single fuel supply 202, such as a natural gas supply line or a propane tank. Gaseous fuel (e.g., natural gas or propane) is flowable from the pressurized fuel supply 202 to first burner stage 130 and second burner stage 132. More specifically, fuel supply 202 selectively provides a primary flow of fuel (indicated by reference numeral 204) through a primary fuel conduit 206.

Fuel supply system 200 may further include a control valve 210 operably coupled to primary fuel conduit 206 for selectively directing a metered amount of fuel to gas burner assembly 110. More specifically, according to the illustrated embodiment, control valve 210 is a single outlet rotary gas control valve including a valve inlet 212 fluidly coupled with fuel supply 202 and a valve outlet 214 fluidly coupled with primary fuel conduit 206 for regulating the primary flow of fuel 204. According to the exemplary embodiment, control valve 210 is operably coupled with control knob 172 such that a user of gas burner assembly 110 may manually control the primary flow of fuel 204.

Fuel supply system 200 includes a first fuel supply conduit 220 and a second fuel supply conduit 222 that are split off of primary fuel conduit 206 at a junction 224, e.g., via a plumbing tee, wye, or any other suitable splitting device. Junction 224 may be positioned downstream of control valve 210 and first fuel supply conduit 220 and second fuel supply conduit 222 may be plumbed in parallel between junction 224 and gas burner assembly 110. More specifically, first fuel supply conduit 220 provides fluid communication between primary fuel conduit 206 and first fuel chamber 142 (e.g., of the outer burner stage or first burner stage 130). Similarly, second fuel supply conduit 222 provides fluid communication between primary fuel conduit 206 and second fuel chamber 146 (e.g., of the inner burner stage or second burner stage 132). In this manner, primary flow of fuel 204 may be split at junction 224 into a first flow of fuel 226 flowing through first fuel supply conduit 220 and a second flow of fuel 228 flowing through second fuel supply conduit 222.

As illustrated in FIG. 7, fuel supply system 200 further includes a modulating valve 240 operably coupled to primary fuel conduit 206. More specifically, modulating valve 240 is positioned between control valve 210 and junction 224, e.g., downstream and in series with control valve 210, for regulating the primary flow of fuel 204. As used herein, "modulating valve" may be used to refer to any valve that automatically and incrementally adjusts the flow rate to a desired flow rate. In this regard, for example, modulating valve 240 is an automated valve that precisely controls primary flow of fuel 204 incrementally between a minimum flow rate and a maximum flow rate. According to exemplary embodiments, modulating valve 240 may include one or more feedback sensors and operation of modulating valve 240 may use feedback and control signals to accurately open and close to achieve the desired flow rate.

Notably, modulating valve 240 is capable of receiving control signals or otherwise being controlled from any suitable source. In this regard, according to one exemplary embodiment, modulating valve 240 is controlled by a separate input device positioned on control panel 170 of cooktop appliance 100. More specifically, for example, modulating valve 240 may be controlled using another control knob 172 or by touch screen interface 174. According to still another exemplary embodiment, controller 178 may be programmed to regulate modulating valve 240 according to a pre-programmed, time-dependent operating profile, e.g., associated with a particular cooking cycle or recipe.

According to still another embodiment, modulating valve 240 is controlled by a remote device 242 that is positioned remotely from cooktop appliance 100. In this regard, for example, remote device 242 may be a secondary device such as a remote computer, tablet, or smart phone. A user may use remote device 242 to generate a specific cooking profile or burner operation profile, or to otherwise regulate the operation modulating valve 240. Remote device 242 may then be connected directly or indirectly to modulating valve 240 for regulating operation of modulating valve 240 and the primary flow of fuel 204. For example, according to the illustrated embodiment of FIG. 7, remote device 242 is communicatively coupled to modulating valve 240 through network 184. Alternatively, remote device 242 may be communicatively coupled to controller 178 of cooktop appliance 100 through network 184 to indirectly control modulating valve 240. According to still other embodiments, modulating valve 240 may be controlled by a potentiometer operably coupled to control valve 210 or control knob 172.

It may frequently be desirable to have the ability to independently control first burner stage 130 and second burner stage 132 using fuel supply system 200. For example, to achieve a very low simmer rate, it may be desirable to turn off first burner stage 130 and operate second burner stage 132 at a low flow rate. Therefore, according to an exemplary embodiment, fuel supply system 200 may further include a shutoff valve 250 that is operably coupled to first fuel supply conduit 220. Shutoff valve 250 may generally be configured for closing when a flow rate of fuel through shutoff valve 250 (or through first fuel supply conduit 220) drops below a predetermined flow rate. The predetermined flow rate may be selected by a user, may be associated with a specific condition or event, may be selected to correspond to an operating condition of fuel supply system 200, or may be determined in any other suitable manner.

According to one embodiment, shutoff valve 250 is coupled to first fuel supply conduit 220 to stop the first flow of fuel 226 when a flow rate of the first flow of fuel 226 drops below some predetermined level, such as the flow rate associated with a low simmer operation of gas burner assembly 110. In this manner, when a user rotates knob 172 to the simmer position, the flow rate through first fuel supply conduit 220 drops below the simmer rate and shutoff valve 250 stops the first flow of fuel 226 altogether. Thus, the primary flow of fuel 204 passes entirely through second fuel supply conduit 222 and second burner stage 132 at the simmer flow rate. According to the illustrated embodiment, shutoff valve 250 is a solenoid valve that is in a normally open position and is closed when the flow rate through shutoff valve 250 drops to the simmer flow rate. However, it should be appreciated that shutoff valve 250 could alternatively be any suitable type of valve for regulating the first flow of fuel 226 in any other suitable manner.

Notably, fuel supply system 200 as described above may provide several advantages relative to conventional fuel supply assemblies for a gas burner assembly, such as gas burner assembly 110. For example, independent control of first burner stage 130 and second burner stage 132 may be achieved without requiring a costly plumbing systems and control valves. In addition, using control valve 210 and modulating valve 240 in series permits precise control of gas burner assembly 110 over a very large operating range. Moreover, such control may be achieved by control knob 108, by another interface on control panel 170 (such as touchscreen 174), or by a remote device 242 via network 184. Thus fuel supply system 200 provides improved operability and versatility in the range and precision of burner operation. Other benefits and advantages of the present subject matter will be apparent to those skilled in the art.

Figure 8:
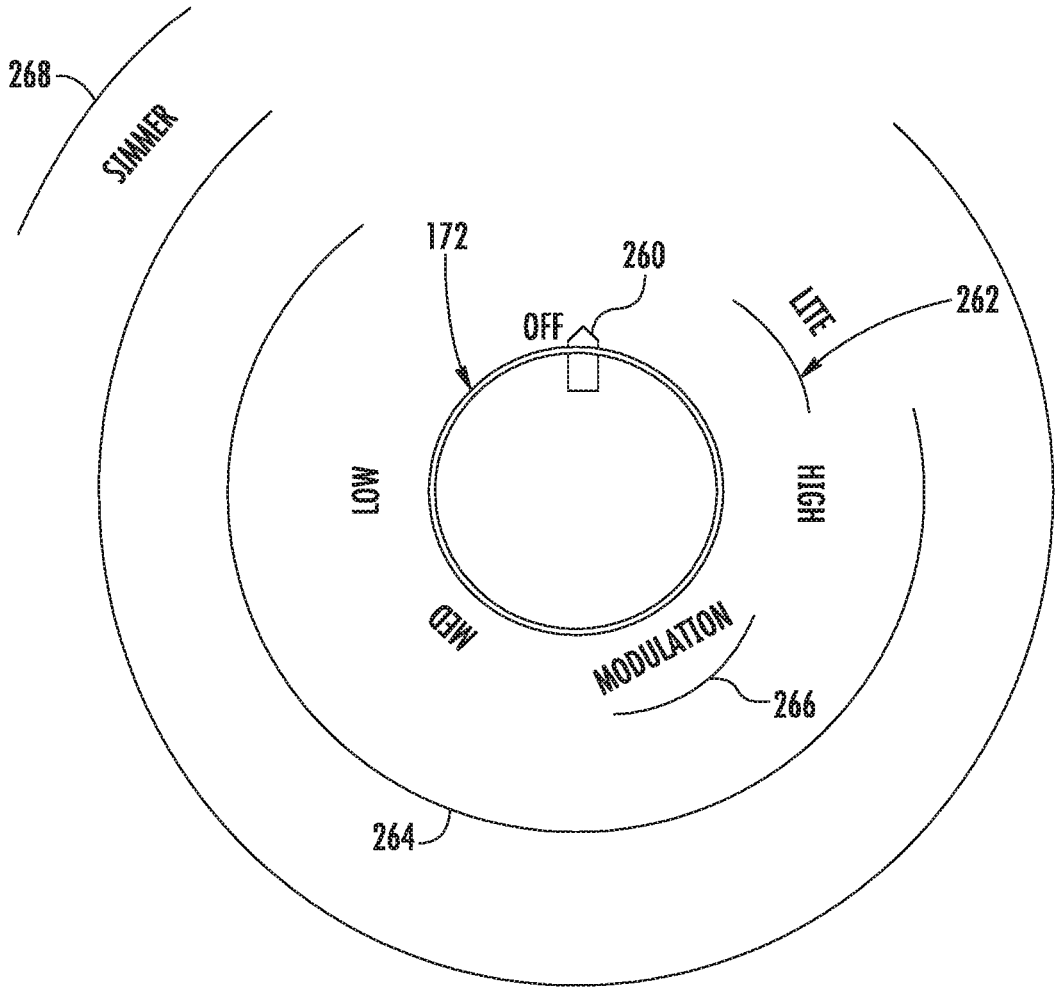
FIG. 8 provides a schematic view of a control knob of the exemplary gas burner assembly of FIG. 2 and modes of operation associated with the positions of the control knob according to an exemplary embodiment of the present subject matter.

Referring now to FIG. 8, control knob 172 of gas burner assembly 100 is illustrated along with various knob positions and the associated operating characteristics of gas burner assembly 100 and fuel supply system 200 when control knob 172 according to an exemplary embodiment. As illustrated, control knob 172 begins in the OFF position, e.g., such that arrow 260 is pointed at 90 degrees or upward as illustrated in FIG. 8. As control knob 172 is rotated clockwise to an ignition position (indicated by reference line 262), maximum gas flow is provided to support ignition and an igniter probe (e.g., such as a spark electrode) is energized to ignite the flow of gas. More specifically, in the ignition position 262, control valve 210, modulating valve 240, and shutoff valve 250 may all be fully open, though other valve positions may be used according to alternative embodiments.

As control knob 172 is progressively rotated clockwise (e.g., within a progressive control range 264 between ignition position 262 and simmer), the flow rate of fuel provided to gas burner assembly 110 corresponds with the high position or a high flow rate, the medium position or a medium flow rate, and the low position or a low flow rate, e.g., the flow rate of gaseous fuel through fuel supply system 200 decreases as control knob 172 rotates clockwise within progressive control range 264. In this manner, control knob 172 is used to control the heat output (e.g., in BTUs) of gas burner assembly 110. Notably, however, when control knob 172 is rotated to a specific position referred to herein as the modulation range (identified by reference numeral 266), fuel supply system 200 may enter a "modulation mode" in which modulating valve 240 regulates primary flow of fuel 204 according to any suitable program or operating cycle, examples of which are described herein.

Referring still to FIG. 8, as control knob 172 is rotated out of the modulation range 266, it may once again regulate within the progressive control range 264 until a simmer range or position 268 is reached. When control knob 172 is positioned in the simmer position 268, shutoff valve 250 may close and primary flow of fuel 204 may directed completely through second fuel supply conduit 222 to second burner stage 132. In this manner, a lower simmer may be achieved in the lower BTU second burner stage 132.

It should be appreciated that the ranges and control knob 172 positions illustrated in FIG. 8 are only used for the purpose of illustrating one exemplary embodiment and are not intended to limit the scope of the present subject matter. For example, according to alternative embodiments, "modulation mode" may be entered in any other suitable manner, such as a separate control button or by actuation via touchscreen interface 174. Once modulating valve 240 is operating, control valve 210 and shutoff valve 250 may be operated independently according to the position of control knob 172. According to still other embodiments, control valve 210 and shutoff valve 250 may be regulated to any suitable position when modulating valve 240 begins regulating primary flow of fuel 204. In this regard, for example, both control valve 210 and shutoff valve 250 may be opened fully when modulation mode is entered or may be set at any other suitable position or flow rate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

a gas burner assembly positioned at the top panel, the gas burner assembly comprising one or more burner bodies defining a first plurality of flame ports, a first fuel chamber in fluid communication with the first plurality of flame ports, a second plurality of flame ports, and a second fuel chamber in fluid communication with the second plurality of flame ports; and a fuel supply system comprising:

a fuel supply for providing a primary flow of fuel through a primary fuel conduit;

a control valve operably coupled to the primary fuel conduit for regulating the primary flow of fuel;

a modulating valve operably coupled to the primary fuel conduit in series with the control valve for regulating the primary flow of fuel;

a first fuel supply conduit providing fluid communication between the primary fuel conduit and the first fuel chamber; and a second fuel supply conduit providing fluid communication between the primary fuel conduit and the second fuel chamber, wherein the first fuel supply conduit and the second fuel supply conduit are split off of the primary fuel conduit at a junction downstream of the control valve and the modulating valve.

2. The cooktop appliance of claim 1, comprising:

a shutoff valve operably coupled to the first fuel supply conduit for selectively stopping the flow of fuel through the first fuel supply conduit.

3. The cooktop appliance of claim 2, wherein the shutoff valve is a solenoid valve configured for closing when a flow rate of fuel through the shutoff valve drops below a predetermined flow rate.

4. The cooktop appliance of claim 3, wherein the predetermined flow rate is equivalent to a simmer flow rate.

5. The cooktop appliance of claim 1, wherein the modulating valve regulates the primary flow of fuel when control valve is positioned in a modulation position.

6. The cooktop appliance of claim 1, wherein the modulating valve is controlled by a separate input device positioned on a control panel of the cooktop appliance.

7. The cooktop appliance of claim 1, wherein the modulating valve is controlled by a remote device from the cooktop appliance.

8. The cooktop appliance of claim 7, wherein the remote device is communicatively coupled to a controller of the cooktop appliance through a network.

9. The cooktop appliance of claim 1, comprising:

a control knob operably coupled to the control valve and being rotatable for controlling the position of the control valve.

10. The cooktop appliance of claim 9, wherein the modulating valve is controlled by a potentiometer operably coupled to the control valve or the control knob.

11. The cooktop appliance of claim 9, wherein the control valve is a rotary gas valve manually controlled by the control knob.

12. The cooktop appliance of claim 1, wherein the first plurality of flame ports define an outer burner stage and the second plurality of flame ports define an inner burner stage positioned concentrically within the outer burner stage.

13. A fuel supply system for a gas burner assembly, the gas burner assembly comprising an inner burner stage positioned concentrically within an outer burner stage, the fuel supply system comprising:

a fuel supply for providing a primary flow of fuel through a primary fuel conduit;

a control valve operably coupled to the primary fuel conduit for regulating the primary flow of fuel;

a modulating valve operably coupled to the primary fuel conduit in series with the control valve for regulating the primary flow of fuel;

a first fuel supply conduit providing fluid communication between the primary fuel conduit and the outer burner stage;

a second fuel supply conduit providing fluid communication between the primary fuel conduit and the inner burner stage, wherein the first fuel supply conduit and the second fuel supply conduit are split off of the primary fuel conduit at a junction downstream of the control valve and the modulating valve; and a shutoff valve operably coupled to the first fuel supply conduit for selectively stopping the flow of fuel through the first fuel supply conduit.

14. The fuel supply system of claim 13, wherein the shutoff valve is a solenoid valve configured for closing when a flow rate of fuel through the shutoff valve drops below a predetermined flow rate.

15. The fuel supply system of claim 14, wherein the predetermined flow rate is equivalent to a simmer flow rate.

16. The fuel supply system of claim 13, wherein the modulating valve regulates the primary flow of fuel when control valve is positioned in a modulation position.

17. The fuel supply system of claim 13, wherein the modulating valve is controlled by a separate input device positioned on a control panel of the gas burner assembly.

18. The fuel supply system of claim 13, wherein the modulating valve is controlled by a remote device from the gas burner assembly.

19. The fuel supply system of claim 18, wherein the remote device is communicatively coupled to a controller of the gas burner assembly through a network.

* * * * *